US006487746B1

(12) United States Patent
Cioci

(10) Patent No.: US 6,487,746 B1
(45) Date of Patent: Dec. 3, 2002

(54) SPONGE MOP WITH FLEXIBLE ENDS

(76) Inventor: Kathyrn Cioci, 126 Wilderness Trail, Watermill, NY (US) 11976

( * ) Notice: Subject to any disclaimer, the term of this patent is extended or adjusted under 35 U.S.C. 154(b) by 43 days.

(21) Appl. No.: 09/825,546

(22) Filed: Apr. 2, 2001

(51) Int. Cl.[7] ..... A47L 13/146
(52) U.S. Cl. ..... 15/119.2
(58) Field of Search ..... 15/116.2, 119.2

(56) References Cited

U.S. PATENT DOCUMENTS 2,469,060 A * 5/1949 Vosbikian et al. ..... 15/119.2
2,678,458 A * 5/1954 Vosbikian et al. ..... 15/116.2

FOREIGN PATENT DOCUMENTS

CA 466474 * 7/1950 ..... 15/119.2

* cited by examiner

*Primary Examiner*—Mark Spisich

(57) ABSTRACT

A sponge mop (10) having unique features such as squeegee left lever slide flexible member (18LAA) and squeegee right lever slide flexible member (18RAA) permitting the user to mop a horizontal floor while concurrently cleaning a vertical baseboard.

5 Claims, 3 Drawing Sheets

SPONGE MOP WITH FLEXIBLE ENDS

BACKGROUND OF THE INVENTION

1. Field of the Invention

The present invention relates to a sponge mop. More particularly, the present invention relates to sponge mop having flexible outer distal ends functioning to permit cleaning of baseboards while mopping.

2. Description of the Prior Art

Numerous innovations for mops are present in the prior art. Even though these innovations may be suitable for the specific individual purposes to which they address, they differ from the present invention as hereinafter contrasted.

The patented inventions differ from the present invention because they fail to describe or claim at least one combination of the following features depicted in the present invention: sponge left outer plate, sponge right outer plate, squeegee left lever slide, squeegee left lever slide flexible member, squeegee right lever slide, squeegee right lever slide flexible member, left mop head housing and right mop head housing.

Numerous innovations for mops are present in the prior art that are adapted to be used. Even though these innovations may be suitable for the specific individual purposes to which they address, they would not be suitable for the purposes of the present invention as heretofore described.

SUMMARY OF THE INVENTION

The present invention relates to a sponge mop, More particularly, the present invention relates to sponge mop having flexible outer distal ends functioning to permit cleaning of baseboards while mopping.

The types of problems encountered in the prior art are sponge mops do not permit the user to clean baseboards while mopping.

In the prior art, unsucessful attempts to solve this problem were attempted namely: fixed vertical members mounted on mops. However, the problem was solved by the present invention because it functions as both a horizontal sponge mop and combination horizontal vertical sponge mop for cleaning baseboards.

Innovations within the prior art are rapidly being exploited in the filed of cleaning utensils.

The present invention went contrary to the teaching of the art which describes and claims fixed vertical mops.

The present invention solved a long felt need for a sponge mop capable of cleaning both horizontal and vertical surfaces concurrently.

Accordingly, it is an object of the present invention to provide a sponge mop having a shaft, mop head, sponge, squeegee, and handle.

More particularly, it is an object of the present invention to provide the mop head having a mop head hinge, left mop head, left mop head housing, right mop head, and right mop head housing.

In keeping with these objects, and with others which will become apparent hereinafter, one feature of the present invention resides, briefly stated, in the sponge having a sponge body, sponge left base plate, sponge left outer plate, sponge right base plate, and sponge right outer plate.

When the squeegee is designed in accordance with the present invention, it has a squeegee slider, squeegee top handle, squeegee bottom handle, squeegee left lever, squeegee left lever slide, squeegee left lever slide flexible member, squeegee right lever, squeegee right lever slide, and squeegee right lever slide flexible member.

The novel features which are considered characteristic for the invention are set forth in the appended claims. The invention itself, however, both as to its construction and its method of operation, together with additional objects and advantages thereof, will be best understood from the following description of the specific embodiments when read and understood in connection with the accompanying drawings.

LIST OF REFERENCE NUMERALS UTILIZED IN THE DRAWINGS

10—sponge mop (10)
12—shaft (12)
14—mop head (14)
14A—mop head hinge (14)
14L—left mop head (14L)
14LA—left mop head housing (14LA)
14R—right mop head (14R)
14RA—right mop head housing (14RA)
16—sponge (16)
16A—sponge body (16A)
16L—sponge left base plate (16L)
16LA—sponge left outer plate (16LA)
16R—sponge right base plate (16R)
16RA—sponge right outer plate (16RA)
18—squeegee (18)
18A—squeegee slider (18A)
18BT—squeegee top handle (18BT)
18BB—squeegee bottom handle (18BB)
18L—squeegee left lever (18L)
18LA—squeegee right lever slide (18LA)
18LAA—squeegee right lever slide flexible member (18LAA)
18R—squeegee right lever (18R)
18RA—squeegee right lever slide (18RA)
18RAA—squeegee right lever slide flexible member (18RAA)
20—handle (20)
22—floor (22)
24—wall (24)

DESCRIPTION OF THE PREFERRED EMBODIMENT

Figure 1:
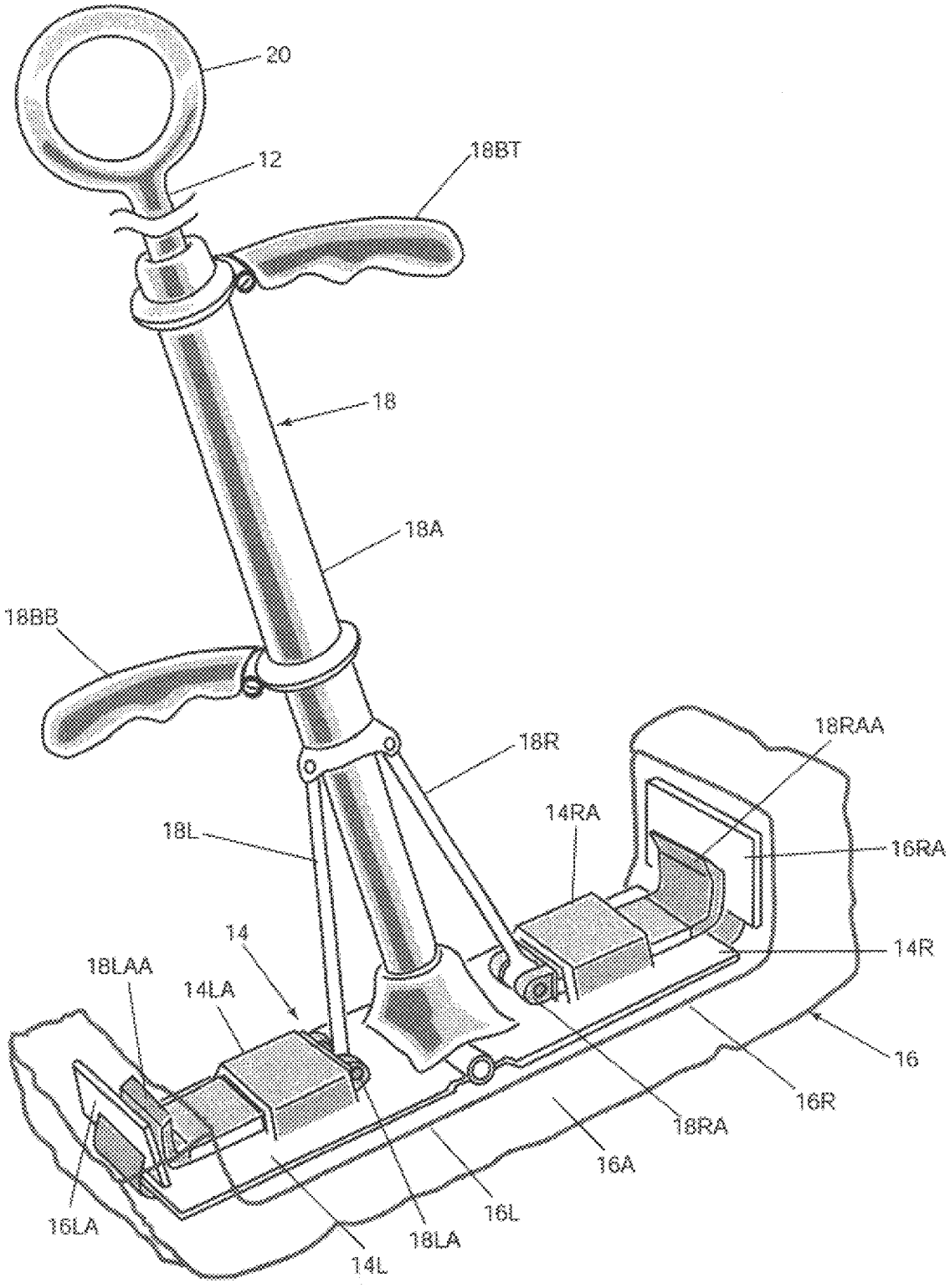
FIG. 1 is a top left front perspective view of a sponge mop (10).
Figure 2:
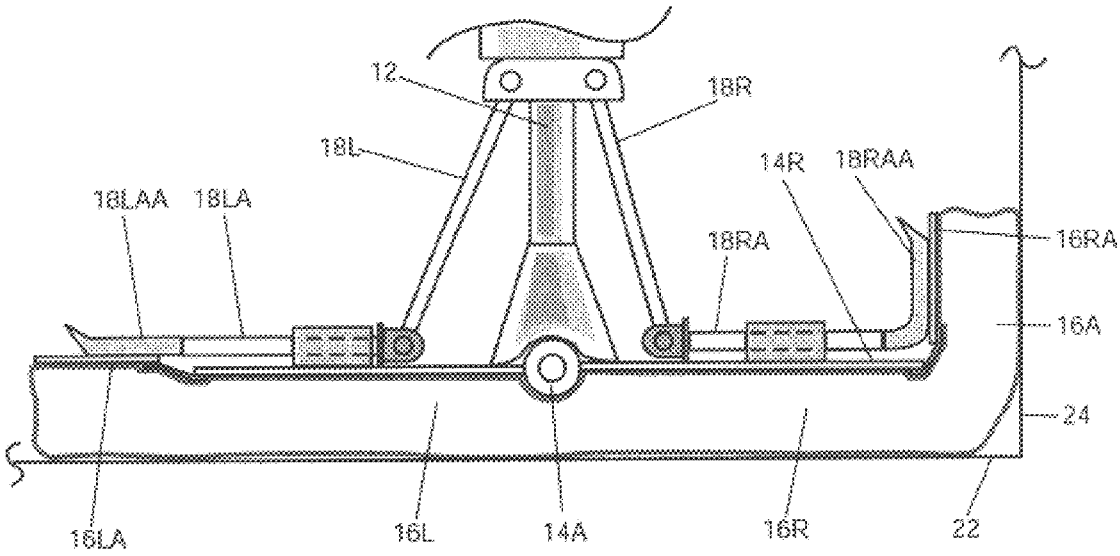
FIG. 2 is a front partial view of a sponge mop (10) exhibiting the sponge body (16A) on an open horizontal configuration.

Firstly, referring to FIG. 1 which is a top left front perspective view of a sponge mop (10) and FIG. 2 which is a front partial view of a sponge mop (10) exhibiting the sponge body (16A) on an open horizontal configuration. The sponge mop (10) comprises a mop head (14) movably connected to a shaft (12) by a mop head hinge (14A). The mop head (14) further comprises a left mop head (14L) securely connected to a left side of the mop head hinge (14A) extending outwardly therefrom and a right mop head (14R) securely connected to a right side of the mop head hinge (14A) extending outwardly therefrom. The left mop head (14L) comprises a hollow left mop head housing (14LA) securely affixed on a top surface thereof. The right mop head (14R) comprises a hollow right mop head housing (4RA) securely affixed on a top surface thereof. The sponge mop (10) may optionally further comprise a handle (20) securely affixed to a top distal end of the shaft (12). The shape of the handle (20) is selected from a group consisting of round, triangle, square, rectangle, pentagonal, hexagonal, heptagonal and octagonal.

The sponge mop (10) further comprises a flexible sponge (16) having a sponge body (16A) is removably securely affixed to the mop head (14). The sponge (16) comprises a sponge left base plate (16L) removably securely affixed to a bottom surface of the left mop head (14L) and a sponge right base plate (16R) removably securely affixed to a bottom surface of the right mop head (14R). The sponge (16) further comprises a sponge left outer plate (16LA) positioned on a left distal end of a top surface of the sponge body (16A) adjacent to the sponge left base plate (16L) and a sponge right outer plate (16RA) positioned on a right distal end of a top surface of the sponge body (16A) adjacent to the sponge right base plate (16R).

The sponge mop (10) further comprises a squeegee (18) having a squeegee slider (18A) movably mounted around the shaft (12). The squeegee (18) further comprises a squeegee left lever (18L) hingably affixed at a top distal end to a bottom left end of the squeegee slider (18A) and hingably affixed at a bottom distal end to a rigid squeegee left lever slide (18LA) having a squeegee left lever slide flexible member (18LAA) extending outwardly therefrom. The squeegee slider (18A) optionally comprises a squeegee top handle (18BT) securely affixed thereto extending therefrom and a squeegee bottom handle (18BB) securely affixed thereto extending therefrom. The squeegee left lever slide (18LA) is movably mounted within the left mop head housing (14LA). The squeegee (18) further comprises a squeegee right lever (18R) hingably affixed at atop distal end to a bottom right end of the squeegee slider (18A) and hingably affixed at a bottom distal end to a rigid squeegee right lever slide (18RA) having a squeegee right lever slide flexible member (18RAA) extending outwardly therefrom, the squeegee right lever slide (18RA) is movably mounted within the right mop head housing (14RA). When the sponge mop (10) is slid along the floor (22) and contacts the wall (24), either the left or right distal end of the sponge body (16A) is able to turn vertically from a horizontal position by the flexibility of the squeegee left lever slide flexible member (18LAA) or squeegee right lever slide flexible member (18RAA).

Figure 3:
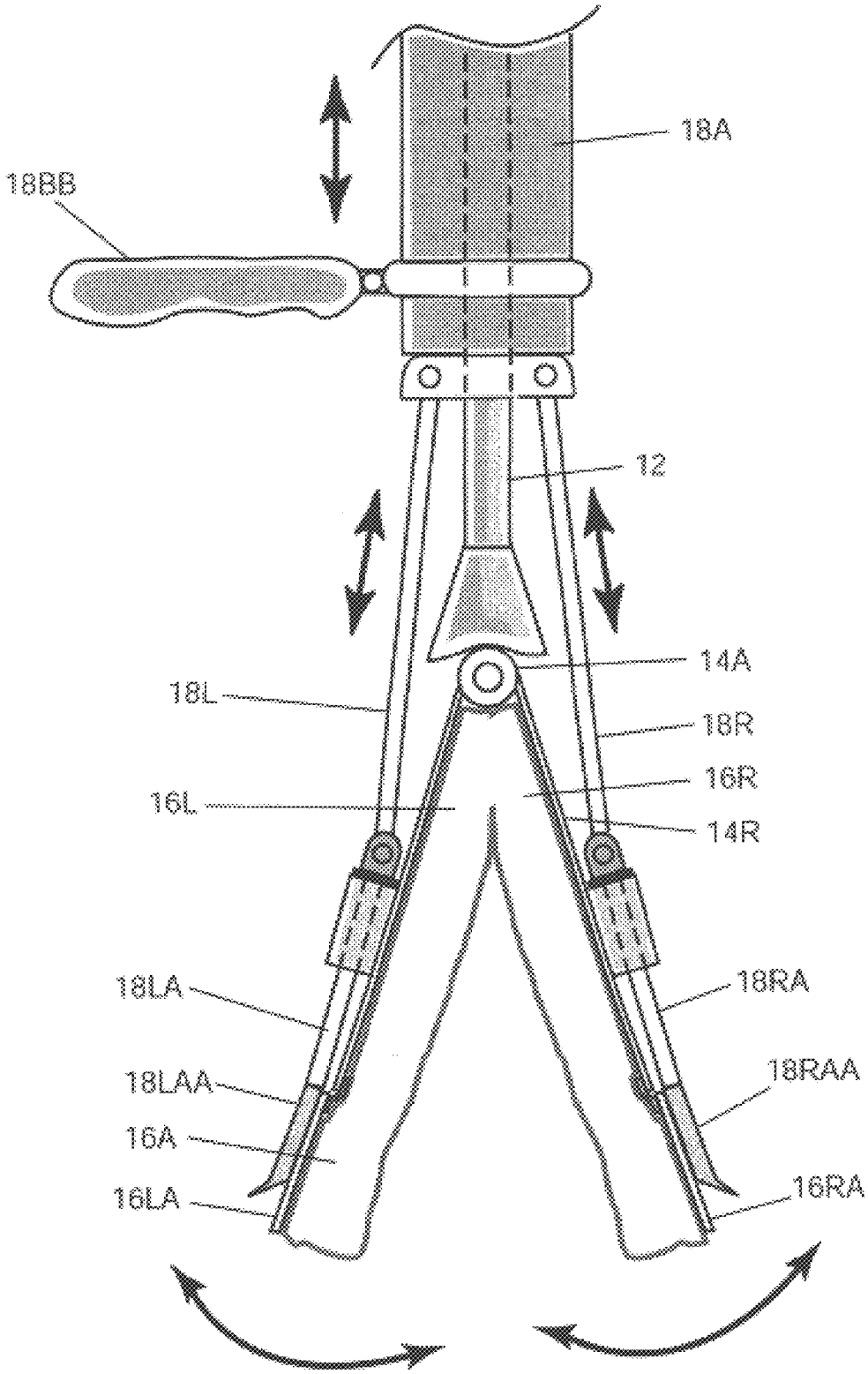
FIG. 3 is a front partial view of a sponge mop (10) exhibiting the sponge body (16A) on a closing vertical configuration functioning to squeeze excess fluid therefrom.

Now referring to FIG. 3 which is a front partial view of a sponge mop (10) exhibiting the sponge body (16A) on a closing vertical configuration functioning to squeeze excess fluid therefrom. During rinsing, excess fluid is removed from the sponge body (16A) by the user moving the squeegee slider (18A) in a downward direction which in turn moves the squeegee left lever (18L) and squeegee right lever (18R) in an outward and downward direction bending the sponge body (16A) in half via the mop head hinge (14A) and moving the rigid squeegee left lever slide (18LA) and rigid squeegee right lever slide (18RA) against the sponge left outer plate (16LA) and sponge right outer plate (16RA), respectively, squeezing the sponge body (16A) expelling fluid therefrom.

It will be understood that each of the elements described above, or two or more together, may also find a useful application in other types of constructions differing from the type described above.

While the invention has been illustrated and described as embodied in a mop, it is not intended to be limited to the details shown, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

What is claimed is:

1. A sponge mop (10) comprising:

A) a shaft (12);

B) a mop head (14) movably connected to the shaft (12) by a mop head hinge (14A), the mop head (14) further comprises a left mop head (14L) securely connected to a left side of the mop head hinge (14A) extending outwardly therefrom and a right mop head (14R) securely connected to a right side of the mop head hinge (14A) extending outwardly therefrom, the left mop head (14L) comprises a hollow left mop head housing (14LA) securely affixed on a top surface thereof, the right mop head (14R) comprises a hollow right mop head housing (14RA) securely affixed on a top surface thereof;

C) a flexible sponge (16) having a sponge body (16A) is removably securely affixed to the mop head (14), the sponge (16) comprises a sponge left base plate (16L) removably securely affixed to a bottom surface of the left mop head (14L) and a sponge right base plate (16R) removably securely affixed to a bottom surface of the right mop head (14R), the sponge (16) further comprises a sponge left outer plate (16LA) positioned on a left distal end of a top surface of the sponge body (16A) adjacent to the sponge left base plate (16L) and a sponge right outer plate (16RA) positioned on a right distal end of a top surface of the sponge body (16A) adjacent to the sponge right base plate (16R);

D) a squeegee (18) having a squeegee slider (18A) movably mounted around the shaft (12), the squeegee (18) further comprises a squeegee left lever (18L) hingably affixed at a top distal end to a bottom left end of the squeegee slider (18A) and hingably affixed at a bottom distal end to a rigid squeegee left lever slide (18LA) having a squeegee left lever slide flexible member (18LAA) extending outwardly therefrom, the squeegee left lever slide (18LA) is movably mounted within the left mop head housing (14LA), the squeegee (18) further comprises a squeegee right lever (18R) hingably affixed at a top distal end to a bottom right end of the squeegee slider (18A) and hingably affixed at a bottom distal end to a rigid squeegee right lever slide (18RA) having a squeegee right lever slide flexible member (18RAA) extending outwardly therefrom, the squeegee right lever slide (18RA) is movably mounted within the right mop head housing (14RA).

2. The sponge mop (10) as described in claim 1, wherein the squeegee slider (18A) comprises a squeegee top handle (18BT) securely affixed thereto extending therefrom.

3. The sponge mop (10) as described in claim 1, wherein the squeegee slider (18A) comprises a squeegee bottom handle (18BB) securely affixed thereto extending therefrom.

4. The sponge mop (10) as described in claim 1 further comprises a handle (20) securely affixed to a top distal end of the shaft (12).

5. The sponge mop (10) as described in claim 4, wherein the shape of the handle (20) is selected from a group consisting of round, triangle, square, rectangle, pentagonal, hexagonal, heptagonal and octagonal.

* * * * *